US007644540B2

(12) United States Patent
Ichinose

(10) Patent No.: US 7,644,540 B2
(45) Date of Patent: Jan. 12, 2010

(54) DOOR OPENING/CLOSING APPARATUS FOR OPERATING MULTIPLE DOORS WITH ONE DRIVING UNIT

(75) Inventor: Mikio Ichinose, Yamanashi (JP)

(73) Assignee: Mitsui Mining & Smelting Co., Ltd., Tokyo (JP)

( * ) Notice: Subject to any disclaimer, the term of this patent is extended or adjusted under 35 U.S.C. 154(b) by 284 days.

(21) Appl. No.: 10/939,478

(22) Filed: Sep. 14, 2004

(65) Prior Publication Data

US 2005/0102905 A1 May 19, 2005

(30) Foreign Application Priority Data

Nov. 19, 2003 (JP) ..... 2003-389177

(51) Int. Cl.
*E05F 11/54* (2006.01)

(52) U.S. Cl. ..... 49/360; 49/340; 49/339

(58) Field of Classification Search ..... 49/360, 49/339–342; 296/50, 55, 146.1, 146.8, 155
See application file for complete search history.

(56) References Cited

U.S. PATENT DOCUMENTS 5,688,019 A * 11/1997 Townsend ..... 296/155
5,896,703 A * 4/1999 Wright et al. ..... 49/339
6,092,336 A * 7/2000 Wright et al. ..... 49/339
6,142,551 A 11/2000 Ciavaglia et al.
6,145,917 A * 11/2000 Ishii et al. ..... 296/146.1
6,305,737 B1 * 10/2001 Corder et al. ..... 296/146.11
6,520,557 B2 * 2/2003 Benthaus et al. ..... 296/76
6,803,733 B1 * 10/2004 Shabana et al. ..... 318/280
7,003,915 B2 * 2/2006 Yokomori ..... 49/360
7,175,228 B2 * 2/2007 Mrkovic et al. ..... 296/155

FOREIGN PATENT DOCUMENTS

| | | |
|---|---|---|
| JP | 09-215268 | 8/1997 |
| JP | 11-026130 | 1/1999 |
| JP | 2000-335245 A | 12/2000 |
| JP | 2001-010346 A | 1/2001 |
| JP | 2002-087065 A | 3/2002 |
| JP | 2003-41853 | 2/2003 |
| JP | 2003-106046 A | 4/2003 |
| JP | 2003-221970 A | 8/2003 |
| JP | 2003-226137 A | 8/2003 |
| JP | 2004-036108 A | 2/2004 |

* cited by examiner

*Primary Examiner*—Gregory J. Strimbu
(74) *Attorney, Agent, or Firm*—Sughrue Mion, PLLC

(57) ABSTRACT

A door opening/closing apparatus is provided with a motor, a first clutch which transmits power from the motor to a door opening/closing mechanism of a slide door when current is applied to the motor while breaking transmission of power to the door opening/closing mechanism of the slide door when current is not applied, and a second clutch which transmits power from the motor to a door opening/closing mechanism of a back door when current is applied while breaking transmission of power from the motor to the door opening/closing mechanism when current is not applied.

1 Claim, 5 Drawing Sheets

DOOR OPENING/CLOSING APPARATUS FOR OPERATING MULTIPLE DOORS WITH ONE DRIVING UNIT

BACKGROUND OF THE INVENTION

1) Field of the Invention

The present invention relates to a door opening/closing apparatus, and in particular to a door opening/closing apparatus for a vehicle.

2) Description of the Related Art

Some vehicles have a door opening/closing apparatus that operates a sliding door to automatically open/close an opening formed on a side of a vehicle. Some other vehicles have a door opening/closing apparatus that opens/closes an opening formed on a rear of a vehicle. Japanese Patent Application Laid-open No. 2001-10346 discloses a conventional art.

Conventionally, one actuator is provided for each door opening/closing apparatus. Therefore, if the vehicle has a number of doors, then a number of actuators are required and the cost of the vehicle disadvantageously increases.

Moreover, generally the door opening/closing apparatus of the rear opening is arranged in the roof of the vehicle. However, if the door opening/closing apparatus is arranged in the roof, the roof bulges. This reduces the space inside the vehicle. Moreover, the bulging becomes obstructs when putting in and taking out luggage. Further, when the door opening/closing apparatus is disposed in the roof, a bracket for mounting the door opening/closing apparatus is required, which increases the cost of the vehicle. In addition, when the door opening/closing apparatus is arranged in a roof of a vehicle having a so-called "three-row seats (a vehicle where two rows of seats are arranged along a longitudinal direction of the vehicle in a compartment behind a driver's seat)", the head of a passenger or a vehicle occupant sitting on the third row seat is positioned close to a bulging portion of the roof, which obstructs getting in and out of the vehicle.

SUMMARY OF THE INVENTION

An object of the present invention is to provide a cheap and compact door opening/closing apparatus.

A door opening/closing apparatus according to an aspect of the present invention includes a driving unit; a first door opening/closing mechanism connected to the driving unit via a first clutch; and a second door opening/closing mechanism connected to the driving unit via a second clutch.

The other objects, features, and advantages of the present invention are specifically set forth in or will become apparent from the following detailed description of the invention when read in conjunction with the accompanying drawings.

DETAILED DESCRIPTION

Exemplary embodiments of a door opening/closing apparatus according to the present invention will be explained in detail with reference to the accompanying drawings. Note that the invention is not limited thereto.

Figure 1:
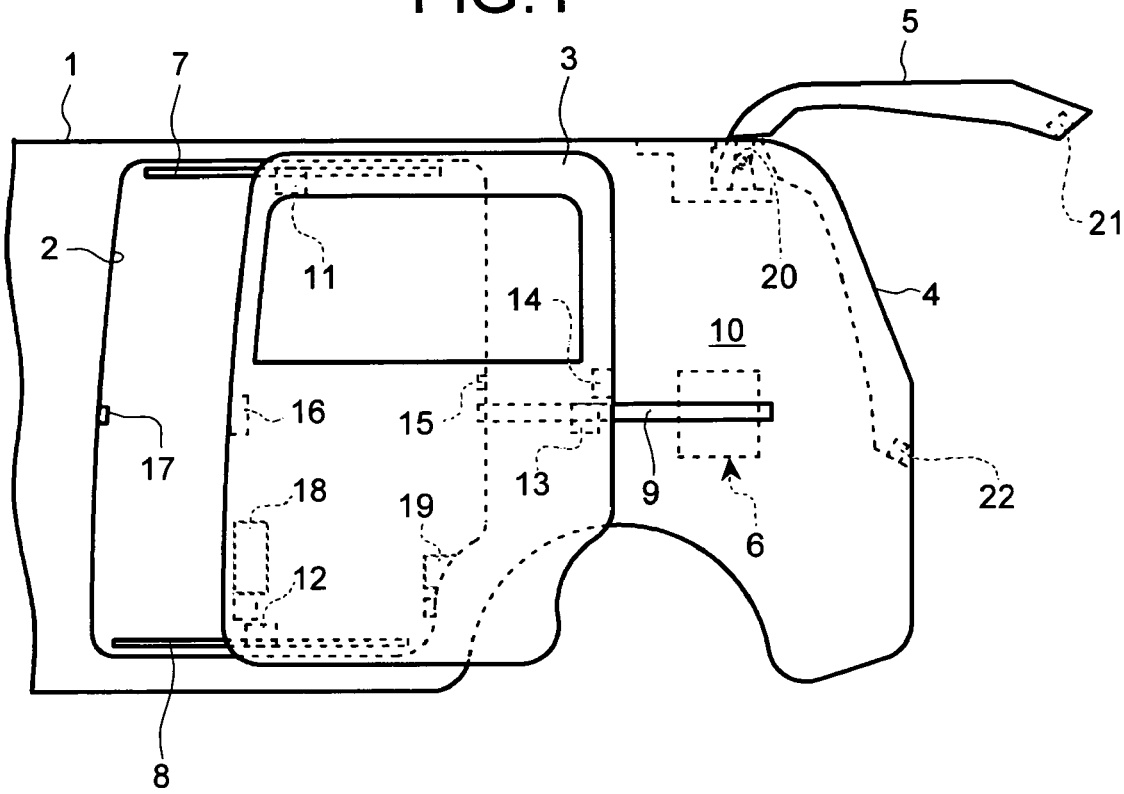
FIG. 1 is a view of a slide door to which a door opening/closing apparatus according to the present invention is applied.
Figure 2A:
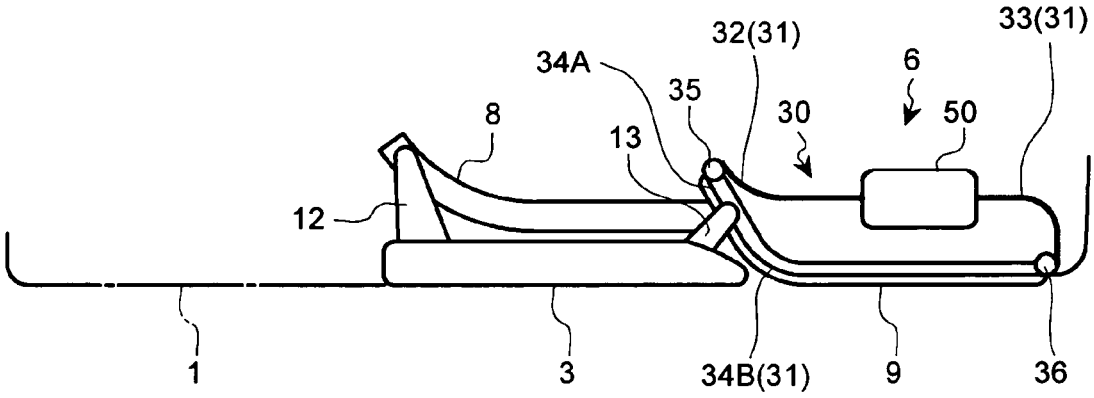
FIG. 2A is a conceptual view of the slide door shown in FIG. 1 viewed from the above, where the slide door is closed.
Figure 2B:
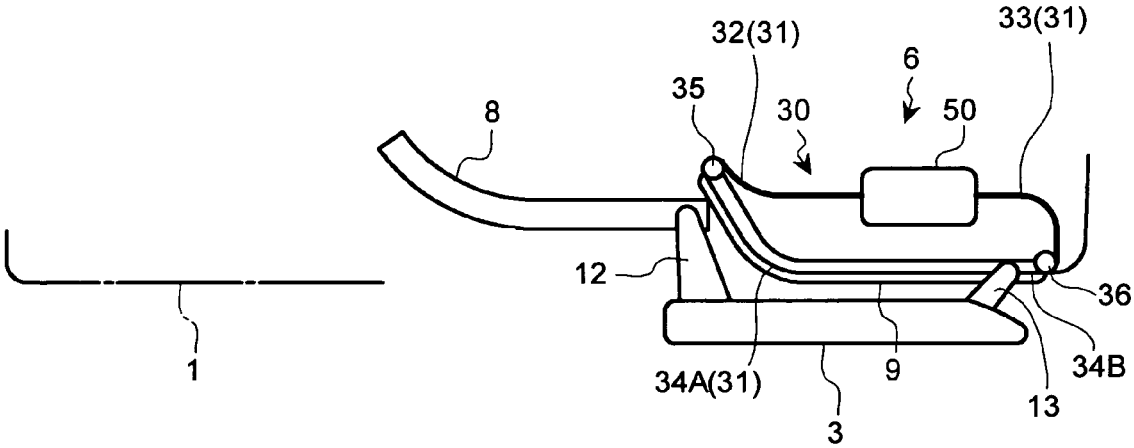
FIG. 2B is a conceptual view of the slide door shown in FIG. 1, viewed from the above, where the slide door is opened.
Figure 3A:
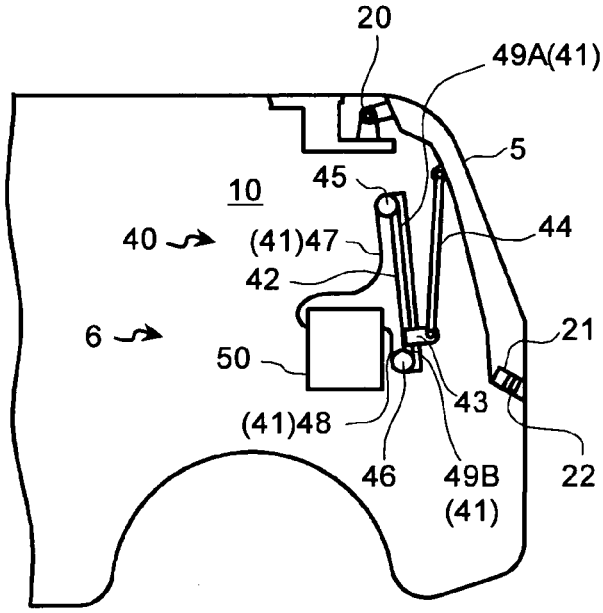
FIG. 3A is a view of a back door to which the door opening/closing apparatus according to the present invention, where a back door is closed.
Figure 3B:
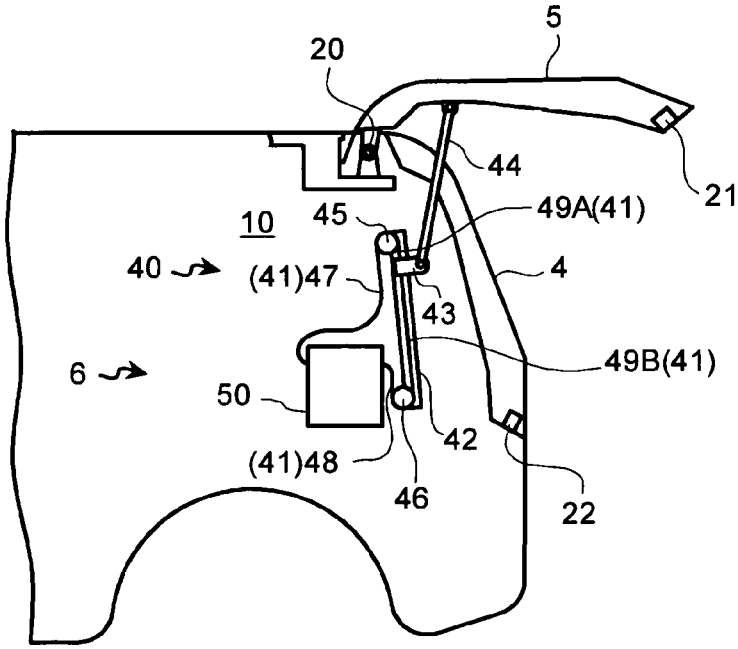
FIG. 3B is a view of the back door to which the door opening/closing apparatus according to the present invention, where the back door is opened.
Figure 4:
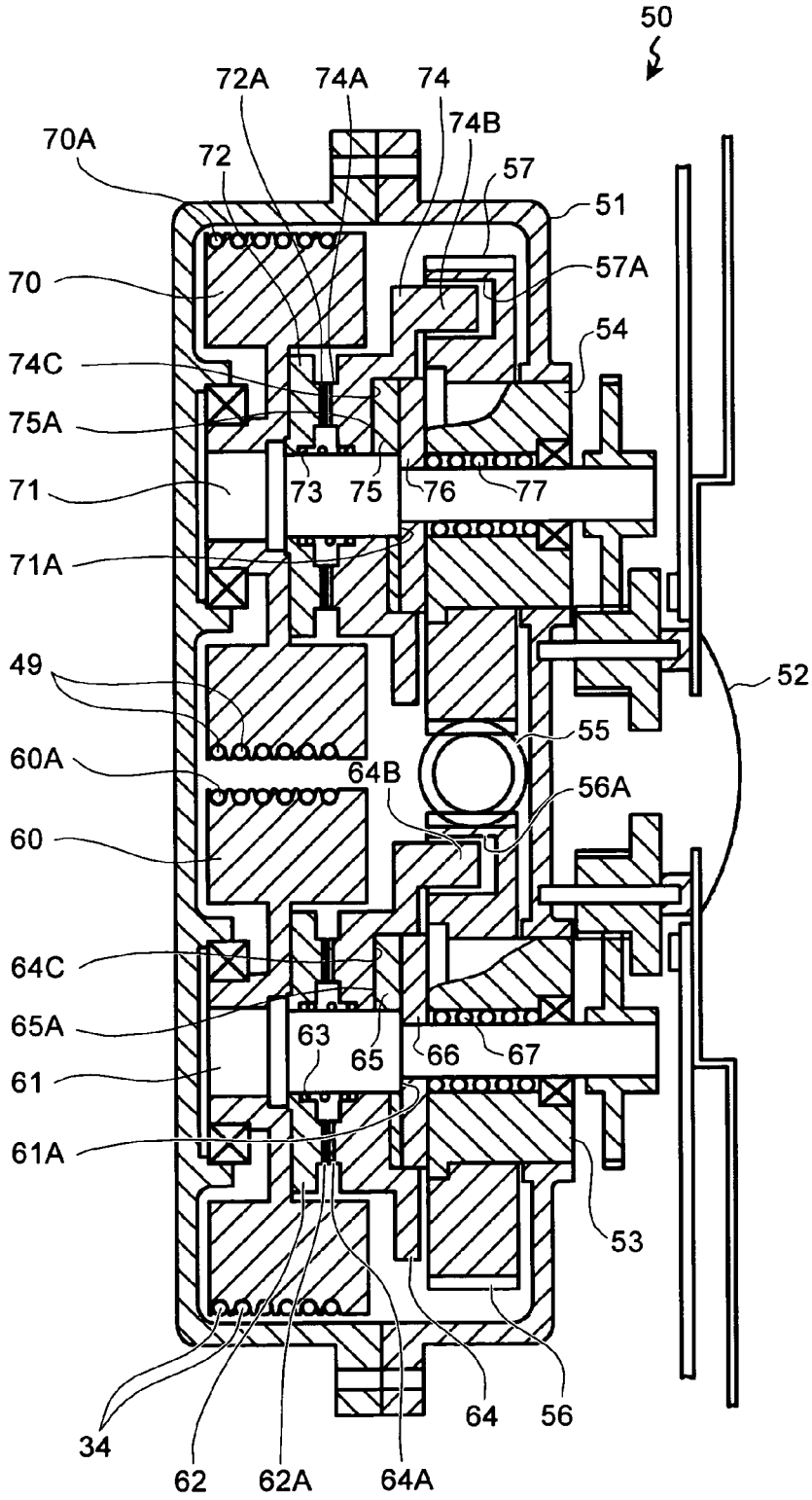
FIG. 4 is a sectional view of an internal structure of a driving unit for a door opening/closing apparatus.

FIG. 1 is a view of a slide door to which a door opening/closing apparatus according to the present invention is applied, FIG. 2A is a conceptual view of the slide door shown in FIG. 1 as viewed downwardly, where the slide door is closed and FIG. 2B is a conceptual view of the slide door shown in FIG. 1 as viewed downwardly, where the slide door is opened, and FIG. 3A is a view of a back door to which a door opening/closing apparatus according to the present invention is applied, where the back door is closed, and FIG. 3B is a view of the back door to which the door opening/closing apparatus is applied, where the back door is opened. FIG. 4 is a sectional view of an internal structure of a power unit of a door opening/closing apparatus.

The door opening/closing apparatus according to the present invention will be explained with an example of a door opening/closing apparatus 6 which is applied to a slide door 3 closing an opening 2 formed in a side of a vehicle 1 and a back door 5 closing an opening 4 formed in a rear of the vehicle 1.

As shown in FIG. 1, the slide door 3 is supported by an upper rail 7, a lower rail 8 and a center rail 9. The upper rail 7 is mounted on an upper edge of the opening 2 formed in the vehicle 1, and the lower rail 8 is mounted on a lower edge of the opening 2. The center rail 9 is mounted on a side surface of a quarter panel 10 positioned at a rear of the vehicle.

The slide door 3 is provided with an upper bracket 11, a lower bracket 12, and a center bracket 13. The upper bracket 11 is mounted on a front upper edge of the slide door 3 and it is slidably engaged with the upper rail 7. The lower bracket 12 is mounted on a front lower edge of the slide door 3 and it is slidably engaged with the lower rail 8. The center bracket 13 is mounted on a rear central portion of the slide door 3 on an inner side of a vehicle compartment and it is slidably engaged with the center rail 9. Therefore, the slide door 3 is slidable in a longitudinal direction of a vehicle and it allows opening/closing of the opening 2.

A latch apparatus 14 is mounted on a rear edge central portion of the slide door 3, and a striker 15 is mounted on a lower rear edge of the opening 2. Therefore, when the slide door 3 is closed, the latch apparatus 14 and the striker 15 are engaged with each other, so that a closed state of the slide door 3 is maintained. Such a structure may be employed that, while a latch apparatus 16 is mounted on a front edge central portion of the slide door 3, a striker 17 is mounted on a front edge of the opening 2.

A full open holder 18 is mounted on a front lower portion of the slide door 3, and a full open striker 19 is mounted on a lower rear edge of the opening 2. Therefore, the slide door 3 is fully opened, the full open holder 18 and the full open striker 19 are engaged with each other, so that a fully opened state of the slide door 3 is maintained.

The back door 5 is for closing an opening 4 formed in a rear of the vehicle, and it is supported by hinges 20 mounted on an upper edge of the opening 4. Therefore, the back door 5 can be opened/closed about the hinges 20 upward and downward.

A latch apparatus 21 is mounted on a lower edge central portion of the back door 5, and a striker 22 is mounted at a lower edge central portion of the opening 4. Therefore, when the back door 5 is closed, the latch apparatus 21 and the striker 22 are engaged with each other, so that a closed state of the back door 5 is maintained.

Gas stays (not shown) are arranged between the back door 5 and the opening 4, thereby facilitating opening/closing the back door 5 and preventing the back door 5 in a course of opening from being closed by a self-weight thereof.

A configuration of the door opening/closing apparatus will be explained next. The door opening/closing apparatus 6 is for opening/closing the slide door 3 and the back door 5, respectively, and it is provided with a door opening/closing mechanism 30 for the slide door 3, a door opening/closing mechanism 40 for the back door 5, and a power unit 50.

As shown in FIGS. 2A and 2B, the door opening mechanism 30 for the slide door 3 is constituted to open/close the slide door 3 through a cable 31, and the cable 31 is provided with a first outer tube 32 connecting the power unit 50 and an front end proximity of the center rail 9, and a second outer tube 33 connecting a rear end of the center rail 9 and the power unit 50, where, after a first inner wire 34A drawn out from the first outer tube 32 is inserted into the center rail 9 via a turn pulley 35 arranged near a distal end proximity of the center rail 9, a second inner wire 34B attached to the center bracket 13 is drawn in from the second outer tube 33 via a turn pulley 36 arranged near a rear end proximity of the center rail 9.

Therefore, the power unit 50 draws out the inner wire 34A (or 34B) from one outer tube 32 (or 33) and draws in the inner wire 34B (or 34A) from the other outer tube 33 (or 32), so that the slide door 3 is opened or closed. That is, the power unit 50 draws out the second inner wire 34A from the first outer tube 32, while drawing in the first inner wire 34A from the second outer tube 33, so that the slide door 3 is transited from a closed state shown in FIG. 2A to an opened state shown in FIG. 2B. On the other hand, the power unit 50 draws in the first inner wire 34A from the first outer tube 32, while drawing out the second wire 34B from the second outer tube 33, so that the slide door 3 is transited from the opened state shown in FIG. 2B to the closed state shown in FIG. 2A.

As shown in FIGS. 3A and 3B, the door opening/closing mechanism 40 for the back door 5 is for opening/closing the back door 5 through a cable 41 like the door opening/closing mechanism 30 for the slide door 3, and it is provided with a slide rail 42, a slider 43, and a rod 44.

The slide rail 42 is arranged in an inner space of the quarter panel 10 so as to be generally parallel to the opening 4, and the slider 43 is attached to the slide rail 42 slidably upward and downward or vertically. The rod 44 is rotatably attached to the slider 43 at one end thereof and is rotatably attached to the back door 5 at the other end thereof. Therefore, when the slider 43 moves upwardly, the back door 5 is pushed up so that the back door 5 is opened. On the other hand, when the slider 43 moves downwardly, the back door 5 is drawn in so that the back door 5 is closed.

Turn pulleys 45 and 46 are arranged at an upper position or portion and a lower position of the slide rail 42. A proximity of the turn pulley 45 arranged at the upper position and the power unit 50 are connected by a third outer tube 47, while a proximity of the turn pulley 46 arranged at the lower position and the power unit 50 are connected by a fourth outer tube 48. A third inner wire 49A drawn out from the third outer tube 47 is attached to the slide rail 42 via the turn pulley 45 arranged at the upper position of the slide rail 42, and a fourth inner wire 49B attached to the slide rail is drawn in the fourth outer tube 48 via the turn pulley 46 arranged at the lower position of the slide rail 42.

Therefore, when the power unit 50 draws in the inner wire 49A (or 49B) from one outer tube 47 (or 48) and draws out the inner wire 49B (or 49A) from the other outer tube 48 (or 47), the back door 5 is opened or closed. That it, the power unit 50 draws in the third inner wire 49A from the third outer tube 47, while drawing out the fourth inner wire 49B from the fourth outer tube 48, so that the back door 5 is transited from a closed state shown in FIG. 3A to an opened state shown in FIG. 3B. On the other hand, the power unit 50 draws out the third inner wire 49B from the third outer tube 47, while drawing in the fourth inner wire 49B from the fourth outer tube 48, so that the back door 5 is transited from the opened state shown in FIG. 3B to the closed state shown in FIG. 3A.

As shown in FIGS. 2A to 3B, the power unit 50 is arranged in an inner space of the quarter panel 10, and is provided with a case 51, a motor 52, a first electromagnetic coil 53, and a second electromagnetic coil 54, as shown in FIG. 4. The motor 52, the first electromagnetic coil 53, and the second electromagnetic coil 54 are mounted on the case 51, respectively, and an output shaft of the motor 52 is fixed with a worm gear 55. A first worm wheel 56 meshing with the worm gear 55 is rotatably attached on an outer periphery of the first electromagnetic coil 53, and a second worm wheel 57 meshing with the worm gear 55 is rotatably attached on an outer periphery of the second electromagnetic coil 54. Accordingly, when the motor 52 is rotated, the first worm wheel 56 and the second worm wheel 57 are rotated in directions reversed to each other so that the rotating directions of the first worm wheel 56 and the second worm wheel 57 are determined depending on the rotational direction of the motor 52.

A first wire drum 60 is rotatably attached to the case 51. A spiral grooves 60A is formed on an outer peripheral surface of the first wire drum 60, and the first inner wire 34A and the second inner wire 34B are wound in the groove 60A in the same direction. Accordingly, when the first wire drum 60 is rotated, one inner wire 34A (or 34B) is paid out, while the other inner wire 34B (or 34A) is wound up, so that the slide door 3 is opened or closed.

One end of a first supporting shaft 61 is fixed to the first wire drum 60, and the first wire drum 60 and the first supporting shaft 61 are rotated integrally. The other end of the first supporting shaft 61 penetrates a fixed gear 62, a compression coil spring 63, a movable gear 64, a cam wheel 65, an armature 66, and a compression coil spring 67 in this order, and the first supporting shaft 61 is rotatably attached to the first electromagnetic coil 53. The fixed gear 62 is fixed to the first wire drum 60, and the first wire drum 60 the fixed gear 62 and the first supporting shaft 61 are rotated integrally.

The movable gear 64 is rotatable about the first supporting shaft 61, it is movable in left and right directions regarding the first supporting shaft 61, and the movable gear 64 is biased by the compression coil spring 63 to be separated from the fixed gear 62.

Teeth 62A are formed on a right side surface (a surface opposed to a mounting surface of the first wire drum 60) of the fixed gear 62 radially in a diametrically outward direction, and teeth 64A are formed on a left side surface (a surface facing the fixed gear 62) of the movable gear 64 radially in a diametrically outward direction. When the movable gear 64 is moved leftward against the biasing force of the compression coil spring 63, the teeth 64A formed on the movable gear 64 mesh with the teeth 62A formed on the fixed gear 62.

Legs 64B extending in an axial direction of the movable gear 64 are formed on an outer periphery of a right side surface (a surface opposed to a surface facing the fixed gear 62) of the movable gear 64, and recesses 56A are formed on a left side surface of the first worm wheel 56. The legs 64B formed on the movable gear 64 are respectively formed at positions thereof dividing the movable gear 62 in three equal portions, while the recesses 56A formed on the first worm wheel 56 are respectively formed at positions thereof dividing the first worm wheel 56 in three equal portions. The legs 64B formed on the movable gear 64 and the recesses 56A formed on the first worm wheel 56 are engaged with each other, so that the movable gear 64 is rotated in an interlocking manner with the first worm wheel 56. Even when the movable gear 64 is moved leftward against the biasing force of the compression coil spring 63, the recesses 56A formed on the first worm wheel 56 and the legs 64B formed on the movable gear 64 are maintained in an engagement state, so that the movable gear 64 is rotated in an interlocking manner with the first worm wheel 56.

A cam surface 64C is formed on an inner periphery on a right side surface of the movable gear 64. The cam surface 64C has a top portion, a bottom portion, and an inclined surface, where the top portion and the bottom portion are connected through the inclined surface. That is, the cam surface 64C is a regular annular indented surface on which the top portion, the inclined surface and the bottom portion are repeatedly formed.

The cam wheel 65 is formed at a surface thereof facing the movable gear 64 with a cam surface 65A. The cam surface 65A has a top portion, a bottom portion, and an inclined surface, where the top portion and the bottom portion are connected through the inclined surface, like the cam surface 64C. The top portion of the movable gear 64 and the bottom portion of the cam wheel 65 are combined, so that the movable gear 64 is moved rightward, while the top portion of the movable gear 64 climbs on the inclined surface of the cam wheel 65, the movable gear 64 is moved leftward.

An armature 66 is fixed on the cam wheel 65, and the cam wheel 65 and the armature 66 are rotated integrally. The armature 66 is rotatable about the first supporting shaft 61, and it is movable in left and right directions regarding the first supporting shaft 61. A step 61A is formed on the first supporting shaft 61, and leftward movement of the armature 66 is restricted by the step 61A The armature 66 is biased leftward by the compression coil spring 67, so that the armature 66 is caused to abut on the step 61A formed on the first supporting shaft 61, while being slightly separated from the first electromagnetic coil 53.

The first electromagnetic coil 53, the armature 66, the cam wheel 65 and the movable gear 64 constitutes a first electromagnetic clutch where power transmission is performed when current is applied to the first electromagnetic coil 53, while power interruption is performed when current is not applied.

When power is not supplied to the first electromagnetic coil 53 (when current is not applied), even if the motor 52 is rotated so that power is transmitted from the worm gear 55 to the movable gear 64 via the first worm wheel 56, the first wire drum 60 is freely rotatable, because the teeth 64A formed on the movable gear 64 and the teeth 62A formed on the fixed gear 62 are separated from each other. At this time, the top portion of the cam surface 64C formed on the movable gear 64 and the bottom portion of the cam surface 65A formed on the cam wheel 65 are combined with each other so that the cam wheel 65 is rotated integrally with the movable gear 64 in an interlocking manner.

When power is supplied to the first electromagnetic coil 53 (when current is applied), the first electromagnetic coil 53 is excited to attract the armature 66, thereby causing a braking force in the armature 66. When motor 52 is rotated so that power is transmitted from the worm gear 55 to the movable gear 64 via the first worm wheel 56, the top portion of the formed on the cam surface 64C of the movable gear 64 climbs the inclined surface formed on the cam surface 65A of the cam wheel 65 to move the movable gear 64 leftward. Thereby, the teeth 64A formed on the movable gear 64 and the teeth 62A formed on the fixed gear 62 are caused to mesh with each other, so that power transmitted to the movable gear 64 rotates the first wire drum 60 via the fixed gear 62. The first inner wire 34A and the second inner wire 34B are then moved so that the slide door 3 can be opened or closed.

The rotational direction of the first wire drum 60 is determined depending on the rotational direction of the worm gear 55, and the first worm wheel 56 and the first wire drum 60 are rotated in the same direction.

A second wire drum 70 is rotatably attached to the case 51. A spiral groove 70A is formed on an outer peripheral surface of the second wire drum 70, where a third inner wire 49A and a fourth inner wire 49B are wound in the groove 70A in the same direction. Accordingly, when the second wire drum 70 is rotated, one inner wire 49A (or 49B) is paid out, while the other inner wire 49B (or 49A) is wound up, so that the back door 5 is opened or closed.

One end of a second supporting shaft 71 is fixed to the second wire drum 70, and the second supporting shaft 71 and the second wire drum 70 are rotated integrally. The other end of the second supporting shaft 71 penetrates a fixed gear 72, a compression coil spring 73, a movable gear 74, a cam wheel 75, an armature 76, and a compression coil spring 77 in this order, and the second supporting shaft 71 is rotatably attached to the second electromagnetic coil 54. The fixed gear 72 is fixed to the second wire drum 70, and the second wire drum 70, the fixed gear 72, and the second supporting shaft 71 are rotated integrally.

The movable gear 74 is rotatable about the second supporting shaft 71, it is movable leftward and rightward on the second supporting shaft 71, and the movable gear 74 is biased by the compression coil spring 73 so as to be separated from the fixed gear 72.

Teeth 72A are formed on an outer periphery of a right side surface (a surface opposed to a mounting surface of the second wire drum 70) of the fixed gear 72 radially in a diametrically outward direction, and teeth 74A are formed on a left side surface (a surface facing the fixed gear 72) of the movable gear 74 radially in a diametrically outward direction. When the movable gear 74 is moved leftward against the biasing force of the compression coil spring 73, the teeth 74A formed on the movable gear 74 mesh with the teeth 72A formed on the fixed gear 72.

Legs 74B extending in an axial direction of the movable gear 74 are formed on an outer periphery of a right side surface (a surface opposed to a surface facing the fixed gear 72) of the movable gear 74, and recesses 57A are formed on a left side surface of the second worm wheel 57. The legs 74B formed on the movable gear 74 are respectively formed at positions thereof dividing the movable gear 74 in three equal portions, while the recesses 57A formed on the second worm wheel 57 are respectively formed at positions thereof dividing the second worm wheel 57 in three equal portions. The legs 74B formed on the movable gear 74 and the recesses 57A formed on the second worm wheel 57 are engaged with each other, so that the movable gear 74 is rotated in an interlocking manner with the second worm wheel 57. Even when the movable gear 74 is moved leftward against the biasing force of the compression coil spring 73, the recesses 57A formed on the second worm wheel 57 and the legs 74B formed on the movable gear 74 are maintained in an engagement state, so that the movable gear 74 is rotated in an interlocking manner with the first worm wheel 57.

A cam surface 74C is formed on an inner periphery on a right side surface of the movable gear 74. The cam surface 74C has a top portion, a bottom portion, and an inclined surface, where the top portion and the bottom portion are connected through the inclined surface. That is, the cam surface 74C is a regular annular indented surface on which the top portion, the inclined surface, and the bottom portion are repeatedly formed.

The cam wheel 75 is formed on a surface thereof facing the movable gear 74 with a cam surface 75A. The cam surface 75A has a top portion, a bottom portion, and an inclined surface, where the top portion and the bottom portion are connected through the inclined surface, like the cam surface 74C. The top portion of the movable gear 74 and the bottom portion of the cam wheel 75 are combined, so that the movable gear 74 is moved rightward, while the top portion of the movable gear 74 climbs on the inclined surface of the cam wheel 75, the movable gear 74 is moved leftward.

An armature 76 is fixed on the cam wheel 75, and the cam wheel 75 and the armature 76 are rotated integrally. The armature 76 is rotatable about the second supporting shaft 71, and it is movable in left and right directions regarding the second supporting shaft 71. A step 71A is formed on the second supporting shaft 71, and leftward movement of the armature 76 is restricted by the step 71A.

The armature 76 is biased leftward by a compression coil spring 77, so that the armature 76 is caused to abut on the step 71A formed on the second supporting shaft 71, while being slightly separated from the second electromagnetic coil 54.

The second electromagnetic coil 54, the armature 76, the cam wheel 75, and the movable gear 74 constitutes a second electromagnetic clutch where power transmission is performed when current is applied to the second electromagnetic coil 54 while power interruption is performed when current is not applied.

When power is not supplied to the second electromagnetic coil 54 (when current is not applied), even if the motor 52 is rotated so that power is transmitted from the worm gear 55 to the movable gear 74 via the second worm wheel 57, the second wire drum 70 is freely rotatable, because the teeth 74A formed on the movable gear 74 and the teeth 72A formed on the fixed gear 72 are separated from each other. At this time, the top portion of the cam surface 74C formed on the movable gear 74 and the bottom portion of the cam surface 75A formed on the cam wheel 75 are combined with each other, so that the cam wheel 75 is rotated integrally with the movable gear 74 in an interlocking manner.

When power is supplied to the second electromagnetic coil 54 (when current is applied), the second electromagnetic coil 54 is excited to attract the armature 76, thereby causing a braking force in the armature 76. When motor 52 is rotated so that power is transmitted from the worm gear 55 to the movable gear 74 via the second worm wheel 57, the top portion formed on the cam surface 74C of the movable gear 74 climbs the inclined surface formed on the cam surface 75A of the cam wheel 75 to move the movable gear 74 leftward. Thereby, the teeth 74A formed on the movable gear 74 and the teeth 72A formed on the fixed gear 72 are caused to mesh with each other, so that power transmitted to the movable gear 74 rotates the second wire drum 70 via the fixed gear 72. The third inner wire 49A and the fourth inner wire 49B are then moved so that the back door 5 can be opened or closed.

The rotational direction of the second wire drum 70 is determined depending on the rotational direction of the worm gear 55, and the second worm wheel 57 and the second wire drum 70 are rotated in the same direction.

An operation of the door opening/closing apparatus will be explained next. When the worm gear 55 is rotated in a clockwise direction on FIG. 4, the second inner wire 34B is wound up by power transmitted to the first wire drum 60 and the third inner wire 49A is wound up by power transmitted to the second wire drum 70. When the worm gear 55 is rotated in a counterclockwise direction on FIG. 4, the first inner wire 34A is wound up by power transmitted to the first wire drum 60 and the fourth inner wire 49B is wound up by power transmitted to the second wire drum 70.

When the slide door 3 is opened (transition is performed from the closed state shown in FIG. 2A to the opened state shown in FIG. 2B), the latch apparatus 14 (or 16) and the striker 15 (or 16) is first disengaged from each other. Thereby, the slide door 3 is put in an openable condition, and the motor 52 is rotated in the clockwise direction on FIG. 4 to move the first worm wheel 56 from the lower side to the upper side on FIG. 4, while power is supplied (current is applied) to the first electromagnetic coil 53. The first electromagnetic coil 53 supplied with power attracts the armature 66 against the biasing force of the compression coil spring 67, thereby causing the armature 66 to generate braking force. Thereby, the movable gear 64 is rotated according to rotation of the first worm wheel 56, while the movable gear 64 is guided by the cam surface 65A of the cam wheel 65 to be moved against the biasing force of the compression coil spring 63 leftward on FIG. 4. The teeth 64A of the movable gear 64 moved leftward meshes with the teeth 62A of the fixed gear 62 and the first wire drum 60 is rotated in the same direction as the first worm wheel 56 to wind the second inner wire 34B. Accordingly, the second inner wire 34B is drawn in the second outer tube 33 and the first inner wire 34A is drawn out from the first outer tube 32.

The center bracket 13 of the slide door 3 is moved rightward on FIG. 2 according to drawing-in of the second inner wire 34B and the drawing-out of the first inner wire 34A, thereby opening the slide door 3. When the slide door 3 reaches the opening position, the full open holder 18 and the full open striker 19 are engaged with each other, thereby stopping driving the motor 52 and stopping supplying power to the first electromagnetic coil 53.

Such a constitution can be employed that, when the slide door 3 is manually opened by a predetermined amount in a state that the latch apparatus 14 (or 16) and the striker 15 (or 17) are disengaged from each other, the slide door 3 is automatically opened by driving the motor 52 and applying current into the first electromagnetic coil 53.

When the slide door 3 reaches the opening position, power supplying to the first electromagnetic coil 53 may be stopped without stopping driving the motor 52. When only power supplying to the first electromagnetic coil 53 is stopped, the movable gear 64 is moved rightward by the biasing force of the compression coil spring 63 on FIG. 4. Since the movable gear 64 moved rightward is separated from the fixed gear 62, the movable gear 64 runs idle so that power transmission to the first wire drum 60 is broken.

On the other hand, when the slide door is closed (when transition is performed from the opened state shown in FIG. 2B to the closed state shown in FIG. 2A), the full open holder 18 and the full open striker 19 are first disengaged from each other. Thereby, the slide door 3 is put in a closable state, and the motor 52 is rotated in a counterclockwise direction on FIG. 4, thereby rotating the first worm wheel 56 from the upper side to the lower side, or downwardly, on FIG. 4, while power is supplied (current is applied) to the first electromagnetic coil 53. The first electromagnetic coil 53 supplied with power attracts the armature 66 against the biasing force of the compression coil spring 67, thereby causing the armature 66 to generate braking force. The movable gear 64 is then rotated according to rotation of the first worm wheel 56 while the movable gear 64 is guided by the cam surface 65A of the cam wheel 65 to be moved leftward on FIG. 4 against the biasing force of the compression coil spring 63. The teeth 64A of the movable gear 64 moved leftward meshes with the teeth 62A of the fixed gear 62, so that the first wire drum 60 is rotated in the same direction as the first worm wheel 56 to wind the first inner wire 34A. Accordingly, the first inner wire 34A is retracted from the first outer tube 32 and the second inner wire 34B is drawn out from the second outer tube 33.

The center bracket 13 of the slide door 3 is moved leftward on FIG. 2 according to retraction of the first inner wire 34A and drawing-out of the second inner wire 34B, so that the slide door 3 is closed. When the slide door 3 reaches the closing position, the latch apparatus 14 (or 16) and the striker 15 (or 17) are engaged with each other (in a half latched state), driving of the motor 52 is stopped, and power supply to the first electromagnetic coil 53 is also stopped. The latch apparatus 14 (or 16) in the half latched state is transited to a fully closed state (a fully latched state) by pulling the slide door 3 by a closer apparatus (not shown).

Such a constitution can be employed that, when the slide door 3 is manually closed by a predetermined amount in a state that the full open holder 18 and the full open striker 19 are disengaged from each other, the slide door 3 is automatically closed by driving the motor 52 and applying current into the first electromagnetic coil 53.

When the slide door 3 reaches the closing position, power supplying to the first electromagnetic coil 53 may be stopped without stopping driving the motor 52. When only power supplying to the first electromagnetic coil 53 is stopped, the movable gear 64 is moved rightward by the biasing force of the compression coil spring 63 on FIG. 4. Since the movable gear 64 moved rightward is separated from the fixed gear 62, the movable gear 64 runs idle so that power transmission to the first wire drum 60 is broken.

When the back door 5 is opened (when transition is performed from the closed state shown in FIG. 3A to the opened state shown in, FIG. 3B), the latch apparatus 21 and the striker 22 are first disengaged from each other. Thereby, the back door 5 is put in an openable condition, and the motor 52 is rotated in a clockwise direction on FIG. 4, thereby rotating the second worm wheel 57 from the upper side to the lower side, or downwardly, on FIG. 4, while power is supplied (current is applied) to the second electromagnetic coil 54. The second electromagnetic coil 54 supplied with power attracts the armature 76 against the biasing force of the compression coil spring 77, thereby causing the armature 76 to generate braking force. The movable gear 74 is then rotated according to rotation of the second worm wheel 57 while the movable gear 74 is guided by the cam surface 75A of the cam wheel 75 to be moved leftward on FIG. 4 against the biasing force of the compression coil spring 73. The teeth 74A of the movable gear 74 moved leftward meshes with the teeth 72A of the fixed gear 72, so that the second wire drum 70 is rotated in the same direction as the second worm wheel 57 to wind the third inner wire 34A. Accordingly, the third inner wire 49A is retracted from the third outer tube 47 and the fourth inner wire 49B is drawn out from the fourth outer tube 48.

The slider 43 is moved rightward on FIG. 3 according to drawing-in of the third inner wire 49A and the drawing-out of the fourth inner wire 49B, thereby opening the back door 5. When the back door 5 reaches the opening position, driving the motor 52 is stopped and supplying power to the second electromagnetic coil 54 is stopped.

Such a constitution can be employed that, when the back door 5 is manually opened by a predetermined amount in a state that the latch apparatus 21 and the striker 22 are disengaged from each other, the back door 5 is automatically opened by driving the motor 52 and applying current into the second electromagnetic coil 54.

When the back door 3 reaches the opening position, power supplying to the second electromagnetic coil 54 may be stopped without stopping driving the motor 52. When only power supplying to the second electromagnetic coil 54 is stopped, the movable gear 74 is moved rightward by the biasing force of the compression coil spring 73 on FIG. 4. Since the movable gear 74 moved rightward is separated from the fixed gear 72, the movable gear 74 runs idle so that power transmission to the second wire drum 70 is broken.

On the other hand, when the back door is closed (when transition is performed from the opened state shown in FIG. 3B to the closed state shown in FIG. 3A), according to a command for closing the back door 5, the motor 52 is rotated in a counterclockwise direction on FIG. 4, thereby rotating the second worm wheel 57 from the lower side to the upper side on FIG. 4, while power is supplied (current is applied) to the second electromagnetic coil 54. The second electromagnetic coil 54 supplied with power attracts the armature 76 against the biasing force of the compression coil spring 77, thereby causing the armature 76 to generate braking force. The movable gear 74 is then rotated according to rotation of the second worm wheel 57 while the movable gear 74 is guided by the cam surface 75A of the cam wheel 75 to be moved leftward on FIG. 4 against the biasing force of the compression coil spring 73. The teeth 74A of the movable gear 74 moved leftward meshes with the teeth 72A of the fixed gear 72, so that the second wire drum 70 is rotated in the same direction as the second worm wheel 57 to wind the fourth inner wire 49B. Accordingly, the fourth inner wire 49B is drawn in from the fourth outer tube 48 and the third inner wire 49A is drawn out from the third outer tube 47.

The slider 43 is moved downwardly on FIG. 3 according to the drawing-in of the fourth inner wire 49B and drawing-out of the third inner wire 49A, so that the back door 5 is closed. When the back door 5 reaches the closed position, the latch apparatus 21 and the striker 22 are engaged with each other (in a half latched state), driving of the motor 52 is stopped and power supplying to the second electromagnetic coil 54 is stopped. The latch apparatus 21 in the half latched state is transited to a fully closed state (a fully latched state) by pulling the back door 5 by a closer apparatus (not shown).

Such a constitution can be employed that, when the back door 5 is manually closed by a predetermined amount, the back door 5 is automatically closed by driving the motor 52 and applying current to the second electromagnetic coil 54.

When the back door 5 reaches the opening position, power supplying to the second electromagnetic coil 54 may be stopped without stopping driving the motor 52. When power supplying to the second electromagnetic coil 54 is stopped, the movable gear 74 is moved rightward by the biasing force of the compression coil spring 73 on FIG. 4. Since the movable gear 74 moved rightward is separated from the fixed gear 72, the movable gear 74 runs idle so that power transmission to the second wire drum 70 is broken.

The door opening/closing apparatus 6 is constituted so as to allow manually opening/closing operation of the back door 5 during a closing operation of the slide door 3 and allow manually opening/closing operation of the slide door 3 during a closing operation of the back door 5. Further, the back door 5 can be operated for opening simultaneously during an opening operation of the slide door 3.

Similarly, the door opening/closing apparatus 6 is constituted so as to allow manually opening/closing operation of the back door 5 during a closing operation of the slide door 3 and allow manually opening/closing operation of the slide door 3 during an opening operation of the back door 5. Further, the back door 5 can be operated for closing simultaneously during a closing operation of the slide door 3.

The door opening/closing apparatus 6 according to this embodiment is provided with the first clutches 53, 66, 65, and 64 serving to transmit power from the motor 52 to the door opening/closing mechanism 30 of the slide door 3, when power is supplied to the first electromagnetic coil 53 (when current is applied), while breaking transmission of power to the door opening/closing mechanism 30 of the slide door 3, when power supplying to the first electromagnetic coil 53 is stopped (when current is not applied). The door opening/closing apparatus 6 according to this embodiment is also provided with the second clutches 54, 76, 75, and 74 serving to transmit power from the motor 52 to the door opening/closing mechanism 40 of the back door 5 when power is supplied to the second electromagnetic coil 54 (when current is applied), while breaking transmission of power to the door opening/closing mechanism 40 of the back door 5 when power supplying to the second electromagnetic coil 54 is stopped (when current is not applied). With this arrangement, at least one of the first and second clutches transmits power from the driving unit to its corresponding door opening/closing mechanism when current is applied to the driving unit. Accordingly, an inexpensive and small-sized door opening/closing apparatus, which allows arbitrary and simultaneous selection of the slide door 3 and the back door 5 and opening/closing operation performed by one motor 52, can be obtained.

Since the inner wires 34B (or 34A) and 49A (or 49B) are drawn in and the inner wires 34A (or 34B) and 49B (or 49A) are drawn out according to rotations of the wire drums 60 and 70, so that the door 3 or 5 is opened/closed, the flexibility for arranging the door opening/closing apparatus 6 is increased. Accordingly, the door opening/closing apparatus 6 can be arranged at any position of the vehicle 1.

Figure 5:
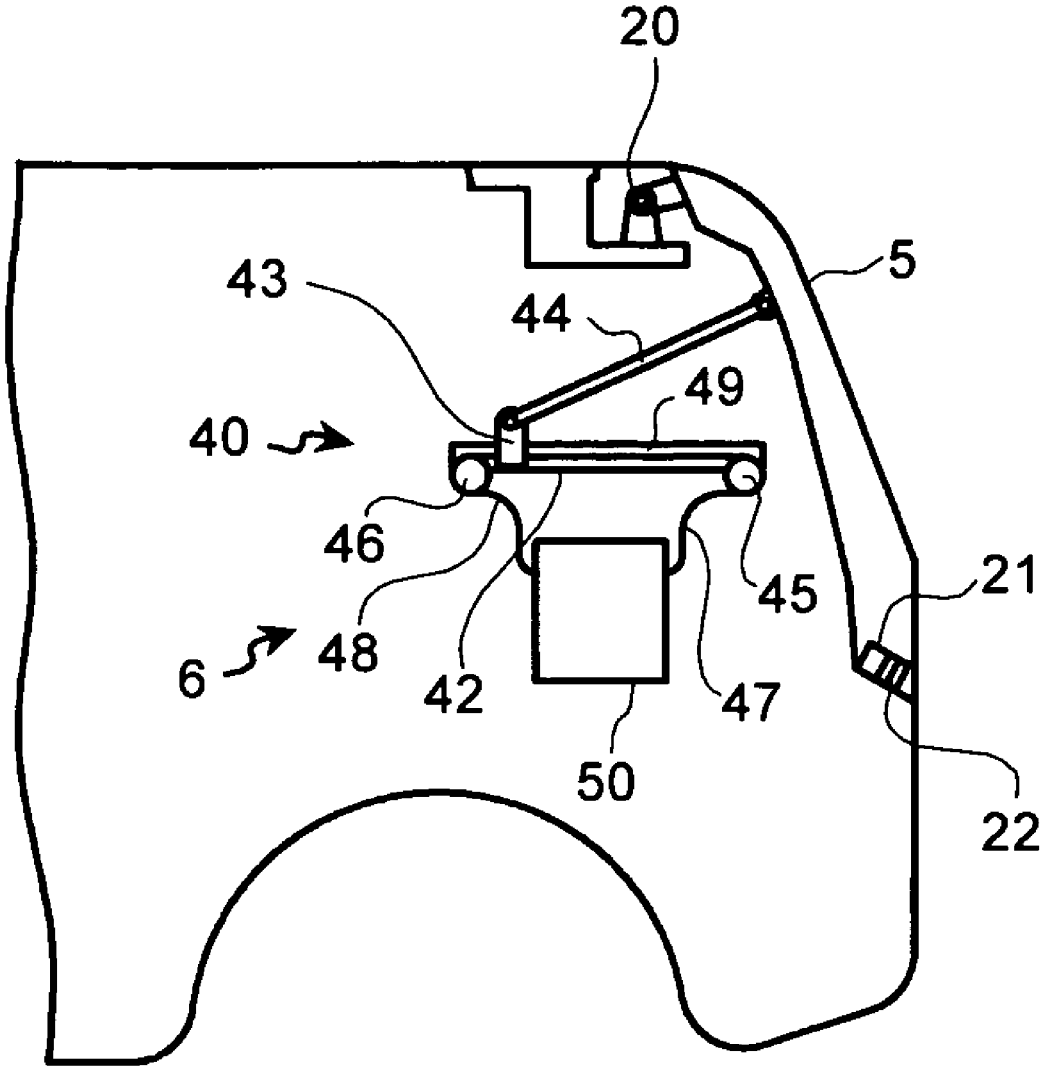
FIG. 5 is a view of another embodiment of a back door to which a door opening/closing apparatus according to the present invention is applied.

In the door opening/closing apparatus 6 for the back door 5 according to the embodiment, the slide rail 42 is arranged in an inner space in the quarter panel 10 so as to be generally parallel to the opening 4, but it may be arranged so as to extend in a longitudinal direction of the vehicle 1, as shown in FIG. 5.

The door opening/closing apparatus according to the present invention allows opening/closing of a plurality of door by one power unit 50, and is not applied only to the combination of the slide door 3 and the back door 5. Therefore, the door opening/closing apparatus according to the invention can be applied to two slide doors 3 which close openings formed on both sides of the vehicle 1.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. A door opening and closing apparatus, comprising:

a driving unit arranged in a vehicle;

a first door opening and closing mechanism connected to the driving unit via a first clutch; and a second door opening and closing mechanism connected to the driving unit via a second clutch, wherein said first door opening and closing mechanism operates an opening and closing of at least a first door, and wherein said second door opening and closing mechanism operates an opening and closing of at least a second door, wherein said first and second doors are disposed separately from each other so as to open and close separate openings, wherein the second door is a door for closing an opening formed in a rear of the vehicle, wherein both of the first and second clutches are capable of transmitting power simultaneously from the driving unit to the first and second door opening and closing mechanisms corresponding thereto when current is applied to the driving unit, while power transmission from the driving unit to at least one of the first and second door opening and closing mechanisms is broken when current is not applied in the driving unit, wherein the driving unit includes a motor having an output shaft fixed to a worm gear, a first worm wheel contacting with the worm gear and the first clutch, and a second worm wheel contacting with the worm gear and the second clutch, wherein when the motor is rotated, the worm gear engagingly rotates the first worm wheel and the second worm wheel simultaneously wherein said first door is a side sliding door which selectively slides in a longitudinal direction of the vehicle, for closing the opening which is formed in a side of the vehicle, and said second door is a tail gate, which is supported by hinges mounted at the opening of the rear of the vehicle, such that said second door pivots about a pivot axis of said hinges as said second door closes the opening formed in the rear of the vehicle.

* * * * *